United States Patent [19]

Hennessy

[11] 4,453,764

[45] Jun. 12, 1984

[54] SLIP ON TRAY FOR INFANT SEAT

[76] Inventor: Michael J. Hennessy, 4142 Couts St., San Diego, Calif. 92103

[21] Appl. No.: 285,943

[22] Filed: Jul. 23, 1981

[51] Int. Cl.[3] ..... A47B 83/02

[52] U.S. Cl. ..... 297/153

[58] Field of Search ..... 297/153, 154, 162, 136, 297/174, 135

[56] References Cited

U.S. PATENT DOCUMENTS

| | | | |
|---|---|---|---|
| 575,288 | 1/1897 | Trimble | 297/173 |
| 1,043,927 | 11/1912 | Harris | 297/153 |
| 1,292,646 | 1/1919 | Reynolds | 297/153 |
| 2,456,111 | 12/1948 | Creech | 297/136 |
| 2,495,843 | 1/1950 | Glenn | 297/154 |
| 3,132,895 | 5/1964 | Pollington | 297/134 |
| 3,155,426 | 11/1964 | Rockwell | 297/136 |
| 3,258,291 | 6/1966 | Ezquerra | 297/217 |
| 3,649,074 | 3/1972 | McDonald et al. | 297/153 |
| 4,165,123 | 8/1979 | Hutson | 297/153 |
| 4,175,786 | 11/1979 | Schaller et al. | 297/254 |

FOREIGN PATENT DOCUMENTS

| | | | |
|---|---|---|---|
| 5745 | of 1915 | United Kingdom | 297/153 |

*Primary Examiner*—Francis K. Zugel

*Attorney, Agent, or Firm*—Brown & Martin

[57] ABSTRACT

A tray for quick and easy installation on an infant seat comprising a tray having an opening therein forming a substantially U-shaped back bar that seats under stop means on the back support of the infant seat, the tray including an upwardly extending enclosure along the forward end and sides.

10 Claims, 6 Drawing Figures

SLIP ON TRAY FOR INFANT SEAT

The invention relates to a tray for quick and easy installation on an infant seat by slipping it over the infant seat and positioning it in place.

BACKGROUND OF THE INVENTION

Various types of infant seats have been provided for use in an automobile so that an infant can be seated in a comfortable and safe position. These infant seats are normally affixed to the automobile seat and have security measures such as safety straps for holding the infant seat on the car seat and for holding the child in the infant seat. These infant seats are used in large numbers and are frequently placed in the automobile seat next to the driver where the driver can observe the infant as required. One difficulty with infant seats is that the infant feels restricted because of the safety straps and soon becomes uncomfortable and bored. The infant expresses its displeasure by squirming and crying and distracts the driver. This annoys the driver and presents a driving hazard.

A tray in front of the infant will enable it to play with items on the tray and keep the infant entertained, avoiding much of the disturbance encountered by the driver. During prolonged driving, snack foods can be made easily accessible on the tray for the infant. Typical tray constructions for an infant seat such as a highchair include heavy tubular support constructions which are pivoted to the seat and are bulky and cumbersome to handle.

A tray has been needed which is simple and easy to attach to the infant seat with a minimum of inconvenience.

SUMMARY OF THE INVENTION

The present invention overcomes the deficiencies of the prior art with a tray device for use with an infant seat having side portions. Includes an opening that forms a back bar for positioning against stop means on the back of the infant seat, the tray device being quickly and easily installed by placing the opening over the back support of the infant seat and engaging the side portions and the stop means with the back bar.

DETAILED DESCRIPTION OF THE INVENTION

Figure 1:
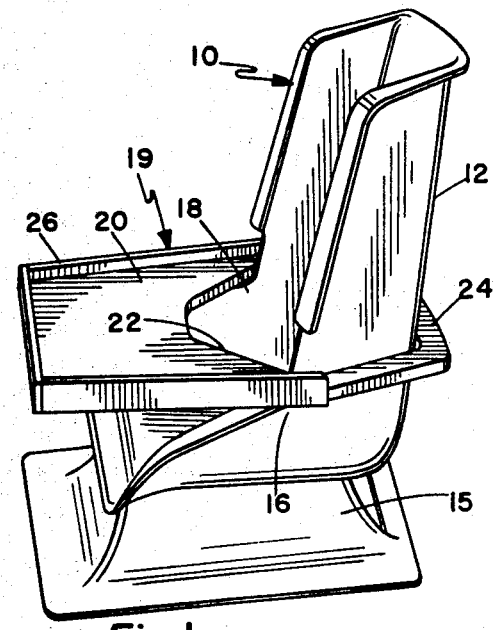
FIG. 1 is a perspective view of a typical infant seat with the tray of the present invention positioned in place.
Figure 2:
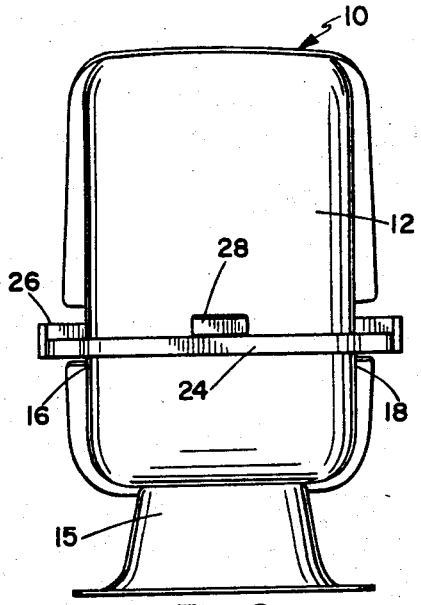
FIG. 2 is a rear elevation view of the seat and tray.
Figure 4:
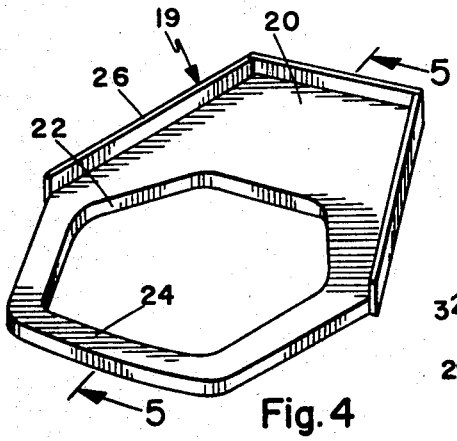
FIG. 4 is a perspective view of the tray of the present invention.

Referring to the drawings, one popular form of infant seat is shown at 10. It includes a back support 12 and side portions 16 and 18 which help contain the child in the seat and generally function as arm rests. The infant seat is shaped to provide a pleasing appearance and includes a platform 15 adapted to be positioned on an automotive vehicle seat. Straps are provided with this type of infant seat for holding it on the vehicle seat and for holding the infant in the infant seat. These straps are not pertinent to the present invention and are not shown in the drawings for the sake of simplicity.

The tray device of the present invention is shown at 19 and includes a tray 20 which is formed of a substantial material such as wood for example. An opening 22 is formed in the tray 20 which results in a substantially U-shaped back rod 24 that conforms to the configuration of the seat 10. The opening 22 extends forward into the tray 20 to provide room for the infant and is shaped to provide maximum tray surface in front and along the side of the infant. The opening is curved to avoid sharp edges. An edge enclosure 26 extends around the front and sides of the tray and is attached to the tray so that toys and objects can be placed on the tray without falling off.

Figure 3:
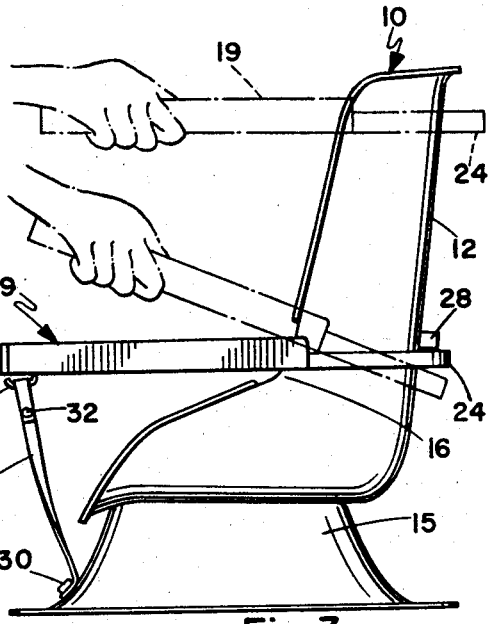
FIG. 3 is a side elevation view of the seat illustrating the method of attaching or removing the tray.
Figure 5:
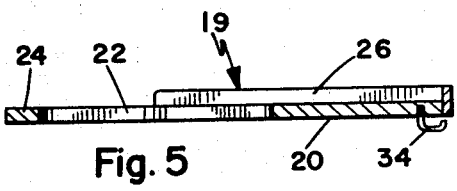
FIG. 5 is a sectional view taken on line 5—5 of FIG. 4.

A stop means in the form of a block 28 is affixed to the back support 12 of the infant seat 10 by any suitable means such as an adhesive. The tray member 19 is positioned on the infant seat 10 as shown in broken lines in FIG. 3 of the drawings. The opening 22 is placed over the back support 12 of the infant seat and is tilted backward so that the back bar 24 will pass below the stop block 28. The forward end of the tray is then tipped down so that the tray engages the side portions 16 and 18 of the infant seat and the back bar 24 moves up to engage the bottom side of the stop block 28 for providing cantilevered support of said tray. The stop block 28 is located so that the tray will be in a substantially level position when it is attached. The tray member 19 is quickly and easily removed by reversing the procedure. No fasteners or pivot construction are required.

A restraining strap 29 (FIG. 3) can be used to secure the forward portion of the tray to the seat and fix it in position. The strap 29 is secured to the platform 15 by any suitable means such as bolt 30, and includes fastening means such as the snap fastener 32 and hook 34 for connecting the strap 29 to the tray member 19.

The tray fits comfortably close around the child and provides substantial space for holding toys or other objects for the child to play with. The edge enclosure keeps such objects from falling off the tray. The tray is substantially flat and has no heavy frame members or the like, making it easy to transport and store.

Figure 6:
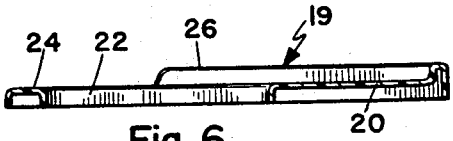
FIG. 6 is a view similar to FIG. 5 showing an alternative one piece plastic tray structure.

Another embodiment of the tray member is shown in FIG. 6 of the drawing wherein the tray is formed of a one piece plastic construction. The configuration of the tray lends itself to plastic molding processes for rapid and relatively inexpensive production.

The tray member of the present invention can be formed to fit different types of infant seat configurations available on the market by changing the shape of the opening.

Having thus described my invention, I claim:

1. A tray for use with an infant seat having a seat portion, a back support, side portions, and stop means on the back of said back support, comprising:

a removeable tray member having an opening therein forming a rear positioning bar, said opening being shaped to fit over the infant seat back support and being of a size such that the tray member can be positioned on the infant seat by tilting it with said rear positioning bar lowered and passing said tray member over the infant seat back support with said rear positioning bar passing over and to a position below said stop means, and then tilting the forward end of said tray member down so that said tray member engages and rests on the side portions of said infant seat and said rear positioning bar engages the lower portion of said stop means for providing cantilevered support of said tray by said side portions and said stop means.

2. A tray for use with an infant seat according to claim 1 wherein the stop means is the primary means for retaining the tray on the infant seat.

3. A tray for use with an infant seat according to claim 1 including an upwardly extending edge enclosure extending along the front and side portion of said tray member.

4. A tray for use with an infant seat according to claim 3 wherein the opening has a curved side wall which extends forward into the tray member to accommodate the occupant and provide substantial tray surface in front of and along the sides of the occupant; and retaining means is provided on the forward portion of said tray member for retaining the forward portion of said tray member in position on said seat.

5. A tray for use with an infant seat according to claim 4 wherein the rear positioning bar is substantially U-shaped.

6. A tray for use with an infant seat according to claim 5 wherein the rear positioning bar fits the contour of the infant seat back support.

7. In combination:

an infant seat having side portions, a back support, and stop means on the rear surface of said back support;

a removeable tray member for positioning on said infant seat, said tray member including an opening shaped to fit over the infant seat back support and forming a rear positioning bar for engaging said stop means, said opening being of a size such that the tray member can be positioned on the infant seat by tilting it with said rear bar lowered and passing said tray member over the infant seat back support with said rear bar passing over and below said stop means, and then tilting the forward end of said tray member down so that said tray member engages and rests on the side portions of said infant seat and said rear positioning bar engages and is retained by the lower portion of said stop means thereby providing cantilevered support of said tray by said side portions and said stop means.

8. The combination according to claim 6 wherein the tray member includes an upwardly extending edge enclosure along the front and side portions thereof.

9. The combination according to claim 8 wherein the side wall of the opening is curved and extends forward into the tray member to accommodate the occupant and provide substantial tray surface in front of and along the sides of the occupant.

10. The combination according to claim 9 wherein the rear positioning bar fits the contour of the infant seat back support.

* * * * *